United States Patent [19]

Perini

[11] Patent Number: 4,487,377

[45] Date of Patent: Dec. 11, 1984

[54] WEB WINDING APPARATUS AND METHOD

[75] Inventor: Fabio Perini, S. Michele di Moriano, Italy

[73] Assignee: Finanziaria Lucchese S.p.A., Lucca, Italy

[21] Appl. No.: 371,388

[22] Filed: Apr. 23, 1982

[30] Foreign Application Priority Data

Aug. 26, 1981 [IT] Italy ..... 9502 A/81

[51] Int. Cl.[3] ..... B65H 35/10; B65H 17/08

[52] U.S. Cl. ..... 242/56.8; 242/66

[58] Field of Search ..... 242/66, 56.8, 56 R; 225/5, 95, 105; 83/342

[56] References Cited

U.S. PATENT DOCUMENTS

| | | | |
|---|---|---|---|
| 1,719,830 | 7/1929 | Cameron | 242/66 |
| 1,779,562 | 10/1930 | Scusa | 242/56.8 |
| 1,976,641 | 10/1934 | Vernon et al. | 242/56.8 |
| 2,203,738 | 6/1940 | Nash | 83/342 X |
| 2,252,734 | 8/1941 | Sherman | 225/105 X |
| 2,266,995 | 12/1941 | Schultz et al. | 242/56.8 X |
| 2,278,029 | 3/1942 | Walsh et al. | 83/342 X |
| 2,670,152 | 2/1954 | Priest | 242/66 |
| 2,951,410 | 9/1960 | Brown | 83/342 X |
| 2,989,262 | 6/1961 | Hornbostel | 242/66 X |
| 3,073,196 | 1/1963 | Marcalus | 242/56 R |
| 3,140,838 | 7/1964 | Hulett | 242/56 R |
| 3,727,854 | 4/1973 | Grotzbach | 242/66 |
| 3,794,228 | 2/1974 | Colwill et al. | 225/105 X |
| 3,863,821 | 2/1975 | Van Bennekom | 225/105 X |
| 4,334,449 | 6/1982 | Hinz et al. | 83/342 |

*Primary Examiner*—Stuart S. Levy
*Assistant Examiner*—Joseph J. Hail, III
*Attorney, Agent, or Firm*—Francis J. Bouda

[57] ABSTRACT

In the high speed rewinder of the present invention a parent roll of paper unwinds from a back-stand to feed a wide web of paper to a perforator, web separator, core-feeder and log rewinder. The perforator includes a stationary ledger blade and a rotating knife-blade roll which cut lines of perforations across the web. The web separator includes a pair of operatively opposed rolls rotating in synchronism, one of which has a spiral groove therein and the other of which has means arranged to force the web of paper into the groove to tear the web within the groove. A secondary winder roll is disposed in spaced relation to the first winder roll. The secondary winder roll can be slowed down to cause the core to advance between the first and second winder roll. A diameter control means is disposed near the secondary winder roll to limit the outer diameter of the finished log of paper. A differential speed between the secondary winder roll and the diameter control roll will move the finished log into a log receiving hopper and differential speed between the first and second winder rolls will advance another core and pick up the leading edge of the just-severed web, advancing the core to repeat the sequence.

15 Claims, 16 Drawing Figures

WEB WINDING APPARATUS AND METHOD

BACKGROUND OF THE INVENTION

The present invention relates to equipment for winding webs of sheet material such as paper, plastic, metal foil, etc., as well as to the method for winding such webs, and relates more particularly to equipment for re-winding big rolls of paper into smaller rolls, which equipment is known in the paper industry as a high speed automatic rewinder.

In the production of toilet tissue, absorbent kitchen towels and other sanitary paper products sold in roll form, it is customary to manufacture the webs of paper in large "parent" rolls on massive paper-making machines. These "parent" rolls may be as large as five feet in diameter and ten to twelve feet in length and, because the paper is extremely thin and light-weight, may contain several miles of paper web.

In order to produce a commercially saleable and easily marketable product, these large "parent" rolls must be rewound into smaller household-size rolls of the type commonly found in kitchens, bathrooms and public toilets around the world. The machine to produce these smaller rolls is called a "re-winder" and although it is under the control of a machine operator, it is generally known as an automatic re-winder because the machine runs continuously, producing from one "parent" roll hundreds of "logs"of small diameter (approximately 4–5 inches) on a cardboard tube or core 10 to 12 feet in length. The web is also perforated into sheet-size sections. All this is done under the pre-controlled settings of the machine once the "parent" roll of paper is installed in the re-winder and the machine is started. Hence the use of the phrase "automatic re-winder". The "logs" are automatically removed from the re-winder and subsequently cut into individual smaller rolls.

It is important in the economy of this industry that such automatic re-winders operate at high speed and produce finished logs of uniform diameter, accurate sheet-count and sheet-length, while at the same time insuring the quality of the product with regard to appearance and also for subsequent handling in packaging machines.

From the foregoing it is evident that of primary importance in this field of endeavour is the provision of effective high-speed equipment which can produce the roll products accurately and efficiently. However, it is equally important that the equipment and the processes be relatively inexpensive and economical to operate.

Although the prior art is replete with disclosures of high speed automatic re-winders, not all of them have been dependable or economical. The present invention provides an apparatus and method for re-winding webs automatically under conditions heretofore not achievable by the prior art devices.

Of particular importance is the provision of devices to provide a "cut-off" of web under controlled conditions so that an absolutely accurate sheet count (or sheet length) is achieved. It is also important that the leading edge of the severed web be transferred to a newly-positioned core rapidly and repeatedly. Further, the diameter of the finished roll or log must be carefully and accurately controlled (despite variations in bulk, caliper, softness, extensibility etc. of the paper).

The prior art of some importance in this field, over which the present invention is an improvement, includes not only my own British Pat. No. 1,435,525 French Pat. No. 2,193,387, German Pat. No. 2,335,930 and Italian Pat. No. 963,047 but also U.S. Pat. Nos. Re. 28,353, 3,247,746, 3,264,921 and 3,179,348 (the latter of which are assigned to the Paper Converting Machine Company of Green Bay, Wis.), 3,540,671 (which is the property of Jagenberg of Germany), 3,148,843 (which is the property of the Hudson-Sharp division of Food Machinery Corp.) and 3,123,315 (which is the property of Dietz Machine Comapny).

SUMMARY OF THE INVENTION

The automatic high-speed winder of the present invention includes a "back-stand" which is capable of holding and rotatably supporting a large "parent" roll of web material such as toilet tissue, kitchen towels or the like. The back-stand includes a roll-rotating arrangement and the web is fed from the "parent roll" to a perforating station where rows of slits are made across the web at spaced intervals (approxmately 4 to 5 inches between the rows of slits) to define the sheet length of the finished product.

After the web has been perforated, the leading edge of the web is transferred to a cut-off roll. The web is wrapped partially around the cut-off roll and then the leading edge is transferred to a small diameter cardboard tube or core. The leading edge is adhesively (or otherwise) secured to the core and the final winding stage is completed to provide a long "log" or roll of paper wound on the core, with the required number of sheets (as defined by the perforations) and required outer diameter.

Thereafter the "tail" of the roll is severed from the web and the new leading edge of the web (just severed from the tail) is transferred to another core, automatically, and the sequence is repeated until the parent roll of paper is completely made up into "logs".

Thereafter a new parent roll is inserted into the back-stand and the procedure repeated.

With the foregoing considerations in mind, it is evident that critical aspects of the production of such paper products or other web-like material are: (1) the efficient and economical operation (at high-speed, with a wide web of paper) of a machine to produce cleanly cut perforations which define sheet-length, (2) the severing of the web along a precise line as determined by sheet-count or roll-length, (3) the timely introduction of the cores to the winding mechanism at the appropriate location, as well as the automatic removal of the finished "logs".

Therefore, a principle object of the present invention is to provide, in a continuous high-speed automatic re-winding machine, a cut-off mechanism which cleanly and precisely severs a wide, fast-moving web of paper in a precise location along the web.

Another object of the present invention is to provide an automatic high-speed re-winding machine which produces exact sheet-count and sheet-length in the rewound smaller rolls of paper.

Another object of the present invention is to provide a cut-off mechanism in an automatic high-speed web re-winder which is inexpensive, easy to maintain at low cost, easy and inexpensive to replace and which operates at a low noise level.

Another object of the present invention is to provide a cut-off roll for an automatic high-speed re-winder which maintains control of not only the trailing edge of the just-cut web but also the leading edge of the advancing web as the new leading edge of the sheet is transferred to another core.

Another object of the present invention is to provide a control mechanism for an automatic re-winding device which operates without a mandrel for the core and which also controls precisely the final diameter of the finished roll.

Another object of the present invention is to provide, in an automatic continuous re-winder a tail-sealing or tail-tacking arrangement which insures that the trailing edge or tail of a just-severed web is securely retained against the outer diameter of the roll.

Still further objects of the present invention are to provide a cut-off mechanism in an automatic web re-winder which transfers the leading edge of the web to a core, selectively with adhesive, or by use of vacuum, electrostatic principles, mechanical devices, pressure means, etc., at the election of the machine manufacturer.

With the above and other objects in view, more information and a better understanding of the present invention will be achieved by referring to the following detailed description.

DETAILED DESCRIPTION

For the purpose of illustrating the invention, there is shown in the accompanying drawings a form thereof which is at present preferred, although it is to be understood that the various instrumentalities of which the invention consists can be variously arranged and organised and that the invention is not limited to the precise arrangements and organizations of the instrumentalities as herein shown and described.

In the drawings, wherein like reference characters indicate like parts:

Figure 1:
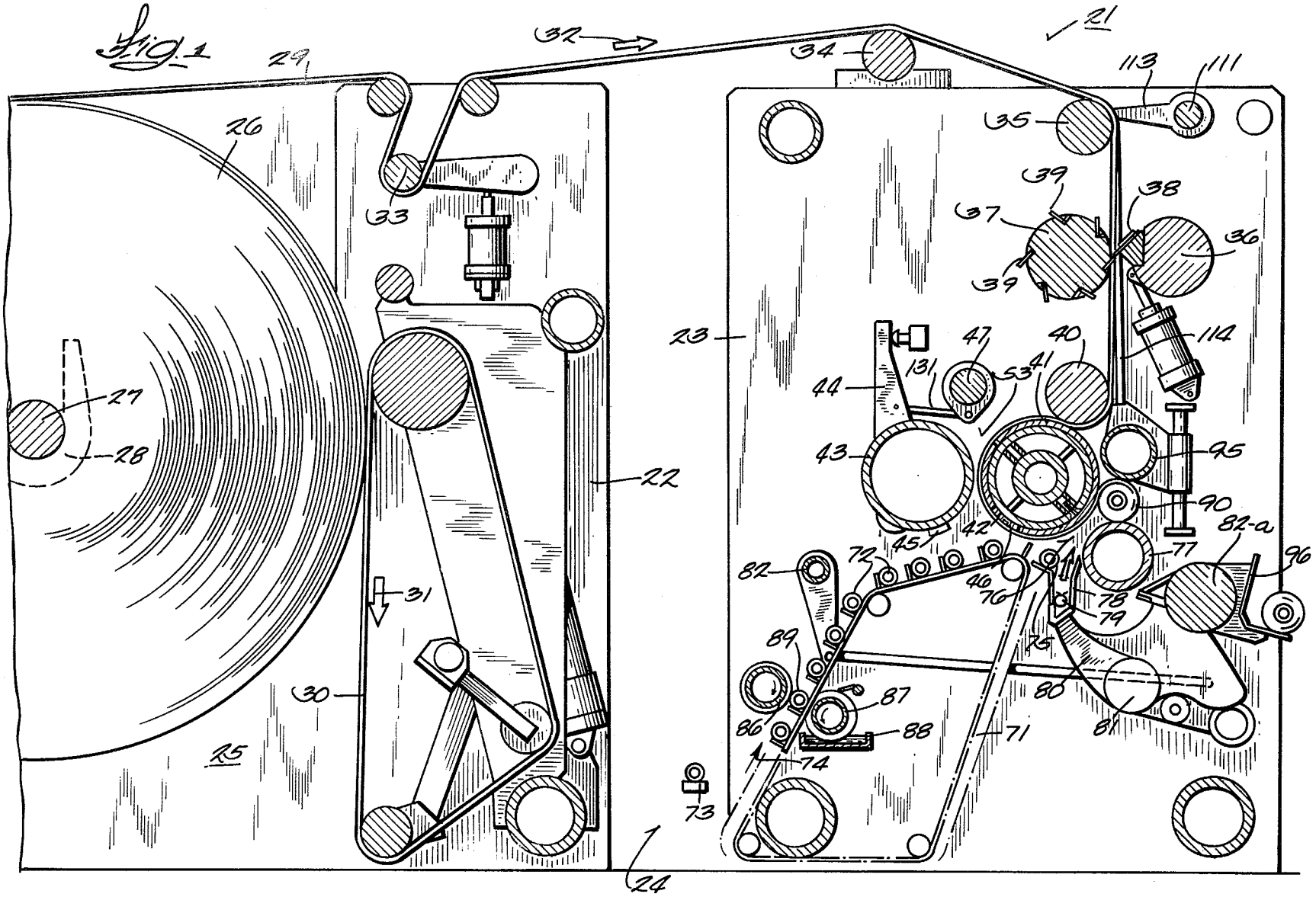
FIG. 1 is a vertical cross-sectional view of the automatic continuous high-speed re-winder of the present invention.
Figure 2:
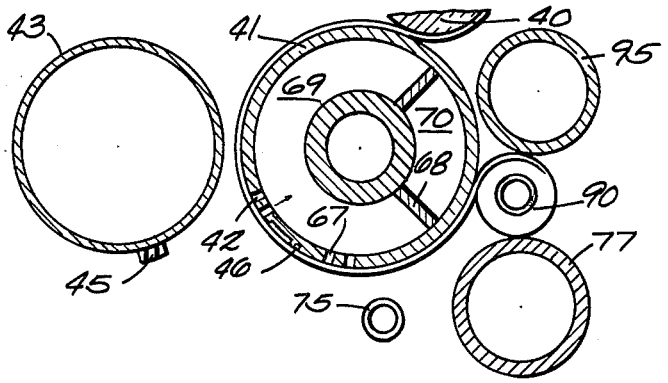
FIG. 2 is a schematic vertical cross-sectional view of the main winding drum and associated parts of the sheet-severing portion of the re-winder shown in FIG. 1.
Figure 3:
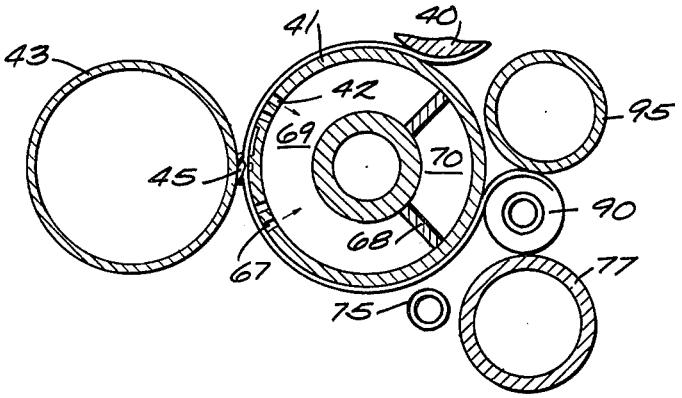
FIG. 3 is a schematic view, similar to FIG. 2, showing the initial position of the leading edge of the web secured to the main winding drum.

Referring now to FIG. 1, the re-winder 21 includes a first frame section 22 and a second frame section 23, spaced apart, to provide a passageway or aisle 24 which permits the machine-operator to pass between the two sections. A back-stand 25 supports a parent roll 26 of paper web which is unwound from the parent roll axle 27 supported in a cradle 28 in the back-stand 25.

The roll 26 is supported for rotation on the axle 27 and is unwound therefrom by a driven unwind belt 30 supported in the frame 22. The belt 30 is appropriately driven by any well-known means (not here described in detail) which causes the belt 30 to move in the direction of the arrow 31 during the operation of the rewinder. The belt 30 is appropriately controlled by the drive means so as to insure that the linear speed of the web 29, as it unwinds from the roll 26, is precisely controlled and maintained in accordance with the demands of the rest of the rewinder system.

Appropriate tension on the web 29 as it moves from the back-stand frame portion 22 to the front winder portion 23, in the direction of the arrow 32, is controlled by the dancer roll 33.

As the web 29 moves in the direction of the arrow 32, it passes into the winder section 23 over a pair of guide rolls 34 and 35 and then moves vertically from the guide roll 35 through the perforating station which consists of a stationary support 36 for a ledger blade, and a rotating knife-blade roll 37.

The support 36 includes a notched perforating blade 38, appropriately mounted thereon, and operating in conjunction with a plurality of cutter knives 39 so as to provide a line of slits across the entire width of the web 29. This perforating roll mechanism may provide the "clean-cut" perforation well known in the art and needs no further description here.

However, it is to be noted that the web 29, while passing through the perforating station does not "wrap" the roll 37 and therefore the linear speed of the web 29 as it passes between the two blades may be either greater or less than the peripheral speed of the roll. This arrangement enables the operator to vary the distance between the rows of perforations and does not limit the distance to the circumferential distance between the knife blades 39. For example, if the linear speed of the web 29 is increased as it passes the ledger blade 38 there will be a greater spacing than the distance between knife blades 39 on roll 37. This result may be obtained either by decreasing or increasing the peripheral speed of the roll 37 with respect to the linear speed of the web 29 or by increasing or decreasing the web speed with respect to the peripheral speed of the roll. If the linear speed of the web 29 is decreased, the distance between rows of perforations will be descreased.

It is to be understood that the difference between the linear speed of the web 29 and the peripheral speed of the roll 37 is not limitless without a tendency for the blades to tear the web 29. Nevertheless, the arrangement shown in FIG. 1 provides flexibility for the user of the machine to change the dimension of the sheets and the distance between lines of perforation in the finished product.

When the web has moved through the perforating station it then passes around a turning roll 40 into contact with the outer surface of the main winding drum 41. This main winding drum 41 will be described in further detail hereinafter.

It will be noted that the web 29, as it comes into contact with the surface of the main winding drum 41, has the leading edge of the web held in contact with the surface of the main winding drum 41 by a vacuum within the drum 41 and which exerts its force through the apertures 42 to hold the web against the outer surface of the drum.

As the main winding drum 41 rotates (in a counter clockwise direction as shown in FIG. 1), the web passes the web separation roll 43 which is supported for rotation on arms 44 so that the roll 43 may move towards or away from the main winding drum 41. In FIG. 1 of the drawings, the roll 43 is shown in a position spaced from the main winding drum. The web-separating mechanism is mounted on the roll 43, and this may include a cut-off knife (well known in the art) or may include a web separating device 45 which operates in conjunction with a channel 46 in the main winding drum 41.

At an appropriate moment the roll 43 swings toward the main winding drum 41 under the impetus of the arm 131 which is connected to the rocker shaft 47. The rocker shaft 47 is indirectly connected (through mechanism not shown) to the rotatable shaft 48 (shown in FIG. 10). This shaft 48 is operatively connected to a cam follower 49 which bears against the edge 50 of the cam 51.

The cam 51, as well as the other cams hereinafter to be described, are mounted on the drive shaft 52 of the cam-control section of the machine and, as the shaft 52 rotates, the cams mounted thereon are turned to operate the web-separation mechanism, core lifter, secondary winder deceleration, and diameter control roll.

Figure 10:
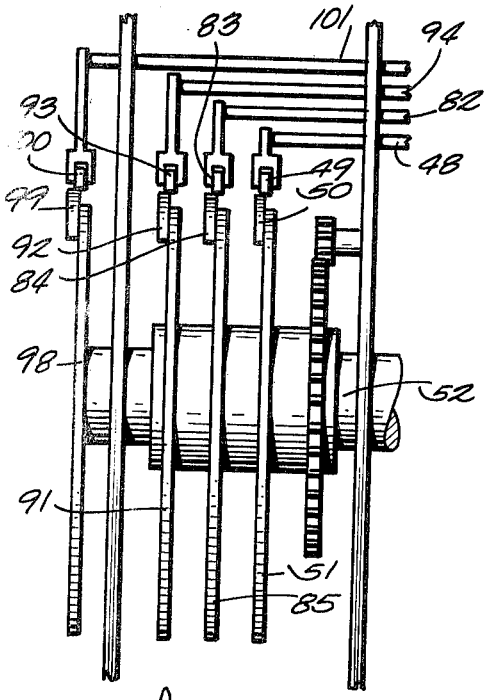
FIG. 10 is a vertical end-view of the camsection of the control mechanism which regulates positions of the various rolls shown in FIGS. 1–7 inclusive.

Referring once again to the web-separation mechanism shown in FIGS. 1 and 10, as the cam 51 is rotated, the roll 43 is swung toward the main winding drum 41 and, inasmuch as the drums 43 and 41 are rotated in synchronism, the web-separator 45 and the channel 46 will come together for an instant at position 53 which is on a line between the axis of the main winder drum 41 and the web-separation roll 43.

Figure 16:
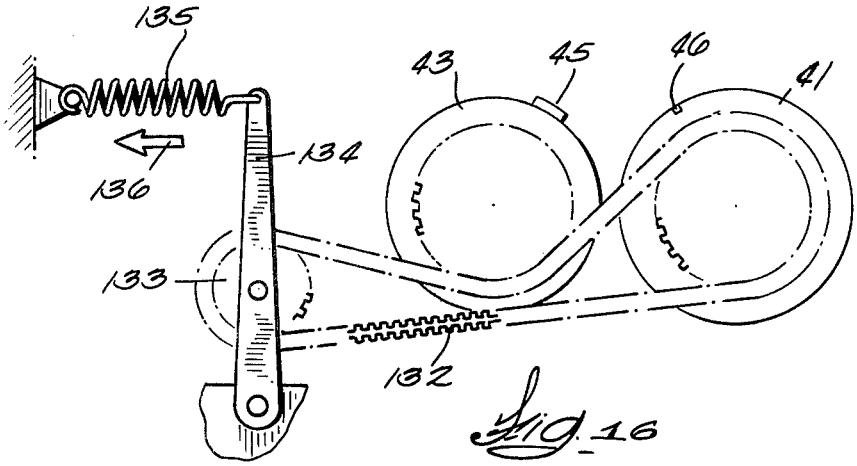
FIG. 16 is a schematic view of the synchronism mechanism for the web-separation device.

The device for maintaining the rolls 41 and 43 in synchronism is shown in FIG. 16. A double-faced timing belt 132 wraps around a toothed portion of the main winding drum 41 and beneath the toothed portion of the web-separation roll 43. A tension roller 133, carried by a pivoted arm 134 and urged by spring 135 in the direction of arrow 136, causes the belt 132 always to be under tension and held tightly against the toothed portions of the drums 41 and 43 even though the drum 43 may be urged by the arm 44 and the web-separation rocker shaft 47 both toward and away from the main winder drum 41.

Figure 9:
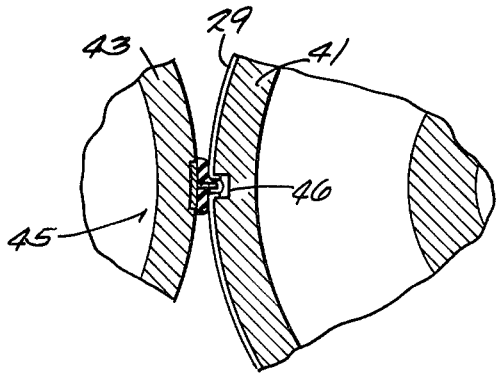
FIG. 9 is a fragmentary cross-sectional view of that portion of the main winding drum which includes the web-severing means.

Referring now to FIG. 9, it can be seen that when the roll 43 is brought against the main winding drum 41, the web separation mechanism 45 depresses the paper web 29 into the channel 46 causing the web to tear or separate within the channel. The web separation may take place with or without a line of perforations overlying the channel 46.

This phenomenon is created because the extent to which the web 29 is pushed into the channel 46 by the web-separation mechanism 45 exceeds the stretch and tensile strength of the paper web.

It is understood that stretch and tensile characteristics of paper webs differ and that the webs may therefore rupture with more or less extension caused by the web-separator 45. However, the width and the depth of the channel 46, as well as the dimensions of the web-separator 45 can be chosen so that the relationship between the dimensions of the separator 45 and the channel 46 are appropriate for the type of paper to be run on the re-winder.

Figure 11:
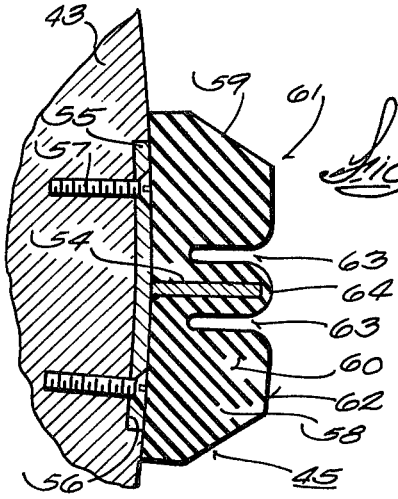
FIG. 11 is a cross-sectional view of the web-separator device of the present invention.
Figure 12:
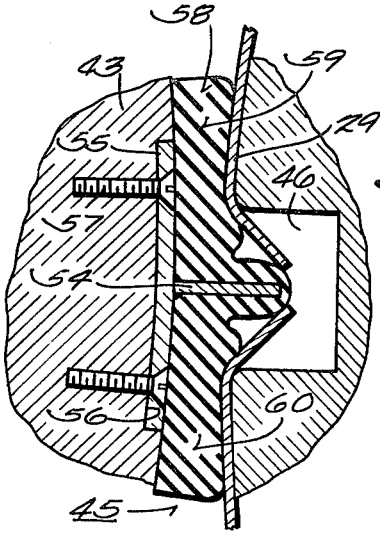
FIG. 12 is a cross-sectional view of a portion of the web-separator roll and of the main winding drum at the moment of interaction of the two rolls to separate the web.

Further details of the web-separator are shown in FIGS. 11 and 12. The web-separator 45 consists of a rigid blade 54 which extends radially outwardly from the roll 43. This blade may have a base portion 55 which is secured to the roll 43, in a recess 56, if desired, or against the surface of the roll 43, if that is more desirable, by the screws 57.

Surrounding the blade 54 is a compressable member 58 which may be made of foam rubber, polyurethane or resilient material and which, preferably, envelopes the blade 54 but also has clamping portions 59 and 60 adjacent thereto.

As can be seen particularly in FIG. 12, the web-separator 45 is located on the roll 43 so that the blade 54 will extend generally centrally into the channel 46. The distance that it extends into the channel 46 is a matter to be determined by the type of paper to be used in the machine and the distance that the web must be depressed into the channel 46 to cause it to rupture. In any event, the tip of the blade 54 does not strike the bottom of the channel 46 and, indeed, it is separated sufficiently from the side-walls of the channel 46 so that there is no likelihood of contact of the blade 54 with any portion of the main winding drum 41.

Both the channel 46 and the web separator 45 are spirally formed in a helix in opposite directions around their respective rolls (in a manner well known in the art) so that at any one instant only a short length of channel 46 and web separator 45 are in contact. This minimizes impact forces, separation energy, noise and wear.

The upper surfaces 61 and 62 of the clamping portions 59 and 60 are disposed to come into contact with the web 29 and to press the web tightly against the surface of the main winding drum 41 on each side of the channel 46, as is shown particularly in FIG. 12.

The compressable member 58 preferably has slits 63 therein, on each side of the blade 54 so that the central portion 64 of the compressable member may easily enter the channel 46 (along with the blade 54) and press the web 29 into the channel 46. This takes place while the clamping portions 59 and 60 are pressing the web 29 tightly against the face of the main winding drum on each side of the channel 46.

Although the blade 54 may be covered at its tip by a portion of the central section 64 of the elastomer 58 so that only the elastomer comes into contact with the paper, in the alternative, the edge of the blade 54 may be sharp and protrude through the elastomer so that it also acts as a cutting edge to help rupture the paper in the channel 46.

It is to be further understood that the web 29 may be held against the surface of the main winding drum 41 at places other than along the edges of the channel 46. For instance, it is possible to eliminate the portions 59 and 60 of the elastomer 58 (retaining only the central portion 64 which depresses the paper into the channel 46) and hold the web 29 in place against the surface of the main winding drum by vacuum mechanism and holes placed closely adjacent to channel 46 (or by any other separate mechanism not an integral part of the web-separator means 45). It is important only that the web 29 be held tightly in an area closely adjacent to the channel 46 at the time that the web-separating means 45 presses the web into the channel 46 until the web stretches beyond its elastic and tensile strength within the channel, rupturing the web in the limited area of the channel 46.

Figure 4:
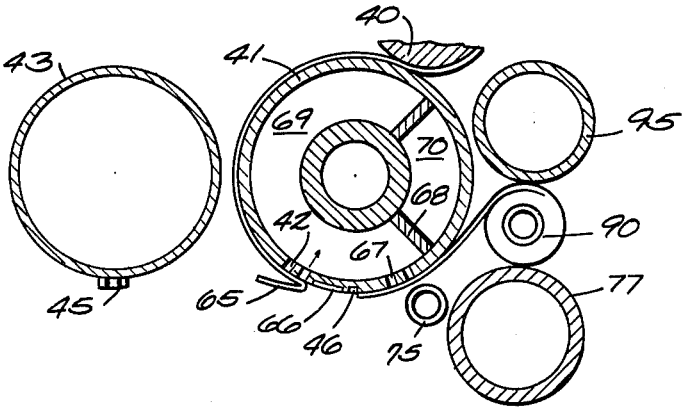
FIG. 4 is a schematic view, similar to FIG. 2, showing the main winding drum rotated so that the leading edge of the web has passed the web severing roll and is moving toward the core position.

After the web is ruptured, continued rotation of the main winding drum 41 carries the leading edge of the sheet counter-clockwise to the position shown in FIG. 4. The leading edge of the web 29 flys rearwardly because it is floating free and is not held against the drum 41 except at the holes 42 where the vacuum created within the main winding drum 41 tightly holds the sheet against the surface.

There is illustrated at 65 in FIG. 4 how the leading edge of the sheet flys rearwardly as the main winding drum 41 carries the web counter-clockwise. At this time a series of short arcuate recesses 66 are exposed on the outer surface of the main winding drum 41. These recesses 66 are described hereinafter.

Figure 5:
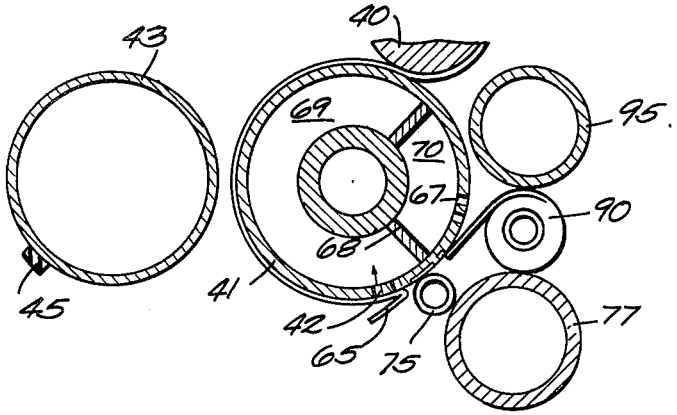
FIG. 5 is a view, similar to FIG. 2, illustrating the core in web-receiving position between the main winding drum and diameter-control roll.

Also as seen in FIG. 4, the vacuum ports 67 provide conduits through which the vacuum within the main winding drum is effected against the trailing edge or tail of the web 29, keeping that portion of the sheet in contact with the surface of the main winding drum until the ports 67 pass the vacuum box wall 68 which divides the vacuum area 69 from the non-vacuum area 70 within the main winding drum 41. This position is shown in FIG. 5.

Referring once again to FIG. 1, it can be seen that while the main winding drum 41 is rotating counter-clockwise and carrying the leading edge of the web counter-clockwise with it, an elevator 71 is carrying a plurality of cores 72 from the core loading station 73 upwardly in the direction of the arrow 74 so as to position a leading core 75 directly beneath the main winding drum 41 and into juxtaposition with the throat 76 formed between the main winding drum 41 and the secondary winding drum 77.

The leading core 75 falls into the hopper 78 and is lifted upwardly therefrom by the rollers 79 on the arm 80 of the core-lifting mechanism 81.

The core lifting mechanism k81 is fastened to a shaft 82 which, as is shown in FIG. 10, is directly connected to the cam follower 83 which bears against the cam plate 84 mounted on the core-lifter cam 85.

The dimensions, position and timing of the core-lifter cam 85 are such as to lift the rollers 79 within the hopper 78 and push the leading core 75 into the throat 76 just as the folded back portion 65 of the leading edge of the web 29 is brought into juxtaposition with the core in the throat (as is shown in FIG. 5).

Prior to the cores reaching the position of leading core 75 shown in FIG. 1, they have passed between the rolls 86 and 87 of the glue applicator station 88. The glue applicator station 88 applies a plurality of peripheral stripes of glue to each core as it passes between the rolls 86 and 87, in locations and positions selected by the machine builder and appropriate to the type of paper to be secured to the core.

The elevator 71 is intermittently operated with dwell positions selected so that the cores move between the glue rolls and stop after the glue is applied. The rolls 86 and 87 rotate in the direction of the arrows at differential speeds so as to rotate the core between them during its passage and thus deposit glue around the entire circumference of the core. Roll 86 rotates faster than roll 87.

As the core rises from the glue application position shown at 89 (between the rolls 86 and 87), the glue remains tacky until it is lifted by the rollers 79 into the throat 76.

Once the leading core reaches the throat 76 (as is shown in FIG. 5), the core surface comes into contact with the outer surface of the main winding drum and also the secondary winding drum and is thus caused to rotate at the same surface speed of these drums so that when the folded-back leading edge 65 of the web is brought between the core and the main winding drum the adhesive stripes on the core will immediately contact the folded-back leading edge of the web and cause the web to stick to the core, thus pulling the leading edge of the web away from the main winding drum (where it was held in place by the vacuum applied through the ports 42).

The secondary winding drum has a plurality of peripheral grooves (not shown) which are in alignment with the peripheral stripes of glue on the core (and indeed in alignment with the recesses 66 on the main winding drum) so that no glue is transferred from the surface of the core to the surface of the main winding drum or the secondary winding drum.

In the short period of time that elapses as the leading core is lifted into the throat 76 and the folded portion 65 of the leading edge of the web contacts the glued surface of the core, the trailing edge or tail of the web (which had heretofore been held in place against the drum at the channel 46 by the vacuum at the ports 67) passes over the non-vacuum area 70 and thus the tail or trailing edge of the already wound roll 90 is released from the main winding drum.

At this instant the secondary winder drum is caused to slow down or decelerate in its rotation. This deceleration is effected through the secondary winder drum deceleration cam 91 shown in FIG. 10 which urges the cam plate 92 against the follower 93 and causes the shaft 94 to rotate. The rotation of the shaft 94 indirectly actuates a control mechanism which may be a series of tapered cone pulleys or a differential gear or a continuous-speed regulator which, through appropriate connections (not shown), causes the secondary winder drum to slow down with respect to the rotary speed of the main winder drum 41 and the diameter control roll 95.

The differential speed causes both the core 75 and the completed roll 90 to move forwardly. That is, the roll 90 moves out of position from between the secondary winder roll 77 and the diameter control roll 95 where it is discharged into a hopper 96. Continued movement of the hopper 96 round the axis of the shaft 82*a* will discharge the completed log of rolled paper into an appropriate log collector device (not shown).

Similarly, the deceleration of the secondary winding drum causes the main winding drum to force the core and newly-created leading edge of the web further through the throat 76 to a position above the secondary winding drum 77 whereupon the diameter control roll 95 is lowered into position on top of the newly placed core (and some length of paper) and the secondary winder drum is brought up to full speed and the winding of the new roll on a newly placed core can now take place.

From this point on the sequence is repeated, each newly placed core having a folded back leading edge of the web applied thereto and brought into position on top of the secondary winding roll and beneath the diameter control roll to form a new "log" of paper.

Figure 7:
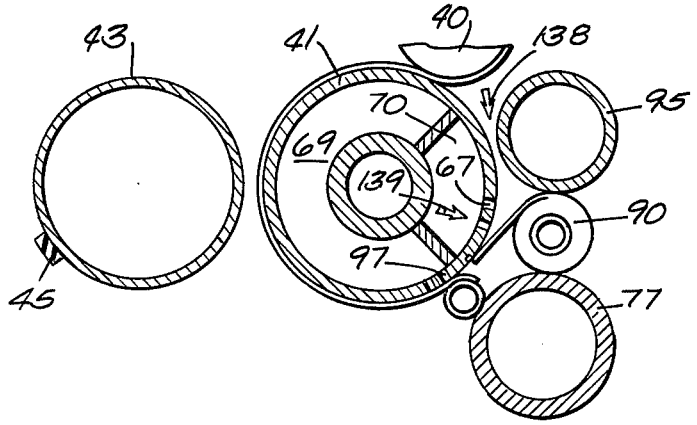
FIG. 7 is a view, similar to FIG. 5, illustrating the arrangement of the main winding drum when there is no fold back of the leading edge of the web, and the transfer is made straightaway to the core.

In FIG. 7 the arrows 138 and 139 indicate positions where air-jets may be employed to assist in removing the tail from the main winding drum 41, either through the ports 67 (as by the jet 139) or externally against the web surface (by jet 138) in the space between the main winding drum 41 and the diameter control roll 95.

Figure 8:
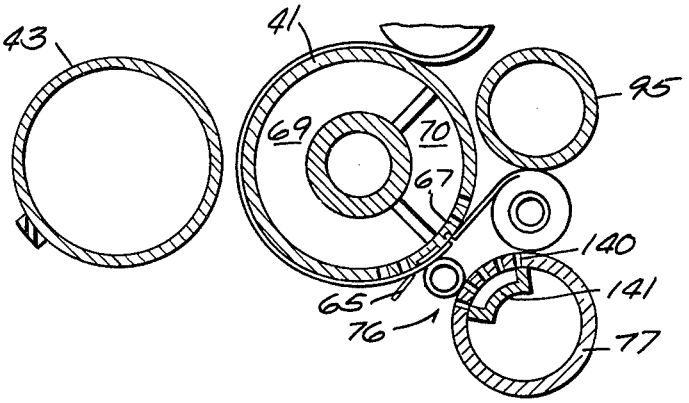
FIG. 8 is a view, similar to FIG. 6, illustrating a modified type of core-advancing mechanism and modified secondary winding drum to provide yet a different mechanism for wrapping the leading edge of the web around the core.

In FIG. 8 there is shown still another form of device to assist in transferring the leading edge of the web to the newly positioned core. The secondary winding drum may have a plurality of ports or apertures 140 formed therein with a vacuum box 141 disposed within the secondary winding drum in the area closely adjacent to the throat 76. Appropriate timing mechanism (not illustrated) may be utilised to apply a vacuum within the box 141 to exert a suction through the ports 140 against the leading edge of the web as it begins to wrap around the core 75. It will be obvious from the drawing in FIG. 8 that the vacuum system for assisting the transfer will not have any adverse effect upon the just-completed roll or the application or tying of the tail to the log.

There is illustrated in FIG. 7 an optional form of application of the leading edge of the web to the core wherein an additional set of ports 97 may be provided within the surface of the main winding drum 41 to hold the very foremost portion of the leading edge of the web against the drum so as to prevent the fold back shown at 65 in FIG. 4.

Figure 6:
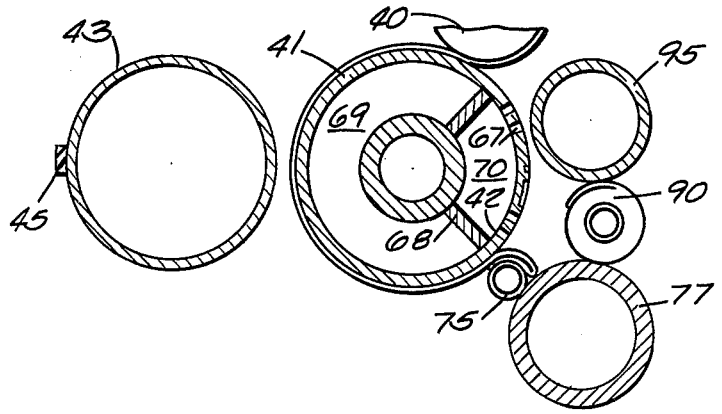
FIG. 6 is a view, similar to FIG. 2, showing the finished roll departing the winder position, the tail of the web separating from the winding drum and the new leading edge of the on-coming web partially wrapped around the core.

Under this circumstance, as the newly elevated core 75 is raised into the throat 76, some of the glue from the core is transferred to the tail of the web which is about to be discharged from the main winding drum and this glue on the tail portion is used to "tie" the tail to the just-completed log. There remains sufficient adhesive on the core stripes to "pick-up" the next leading edge of the web and wrap it around the core similar to that shown in FIG. 6.

Referring once more to FIG. 10, the diameter control roll cam 98 (which is also mounted on the shaft 52) has a cam face 99 which urges the cam-follower 100 in a manner to rotate the shaft 101 and cause the diameter control roll 95 to be elevated above the log 90 under controlled conditions so as to control accurately the diameter of the log 90 as it is being wound between the secondary winder roll 77 and the diameter control roll 95.

Figure 14:
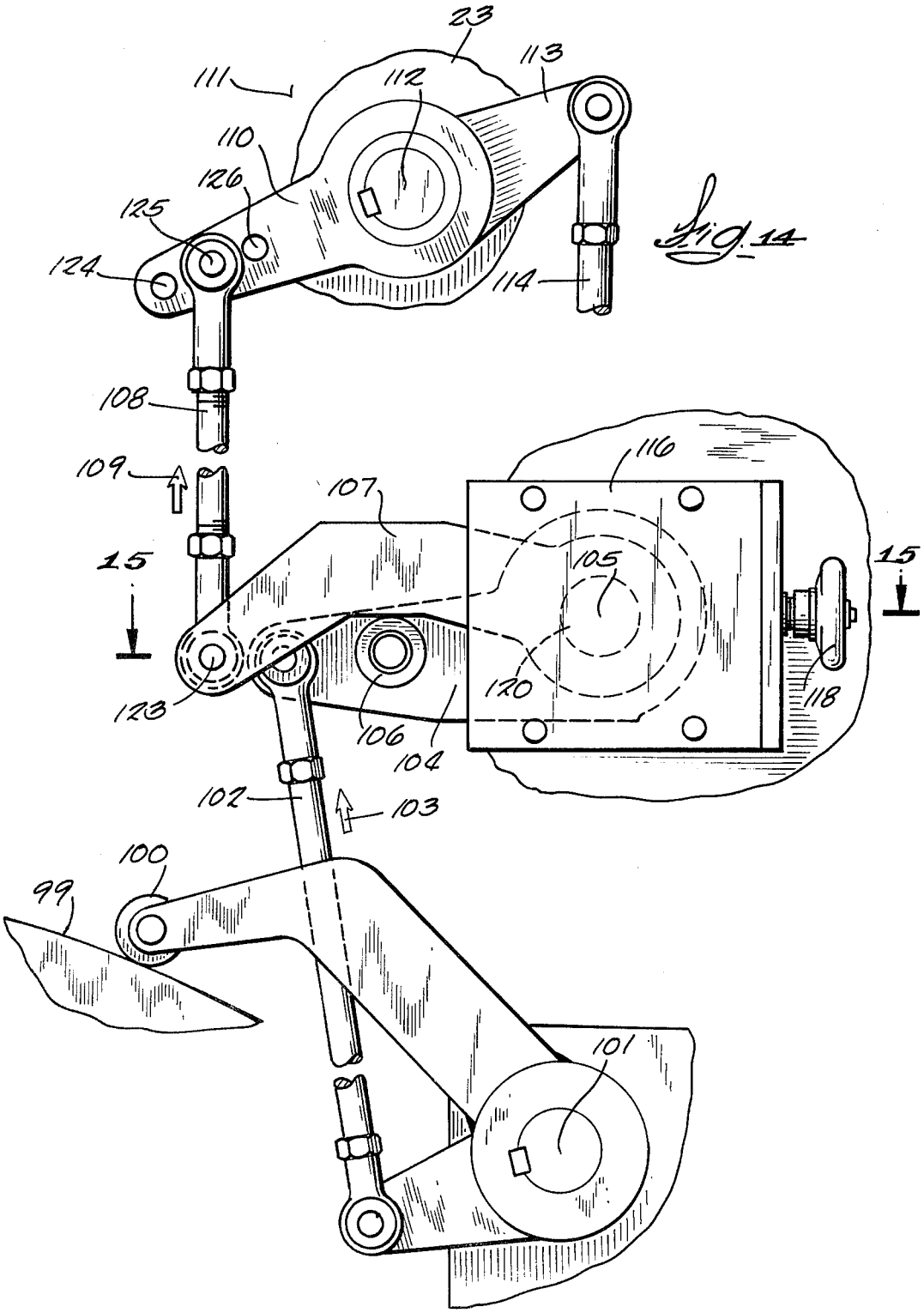
FIG. 14 is a fragmentary view of the variable roll-diameter-control mechanism.

Referring now to FIG. 14, I have illustrated how the cam follower 100 will rotate the shaft 101 under the impetus of the cam follower face plate 99.

As the shaft 101 rotates it moves a connecting rod 102 in the direction of the arrow 103 causing the arm 104 to pivot about the axis 105. Also connected to the arm 104 is a ball-bearing roller 106 which itself bears against the underside of an arm 107, as is shown more clearly in FIG. 15. When the ball-bearing roller 106 is caused to move by the arm 104 it elevates the arm 107 causing the shaft 108 connected thereto to move in the direction of the arrow 109. This shaft 108 is connected to the arm 110 of the bracket 111 which pivots on the axis 112 of the frame member 23. Other arms 113 pivoting about the axis 112 cause the connecting rods 114 to move up and down. Inasmuch as the connecting rods 114 are operatively connected to the diameter control roll 95, the roll 95 is accurately positioned above the log 90 and precisely controls the diameter to which the log 90 can be wound.

Figure 15:
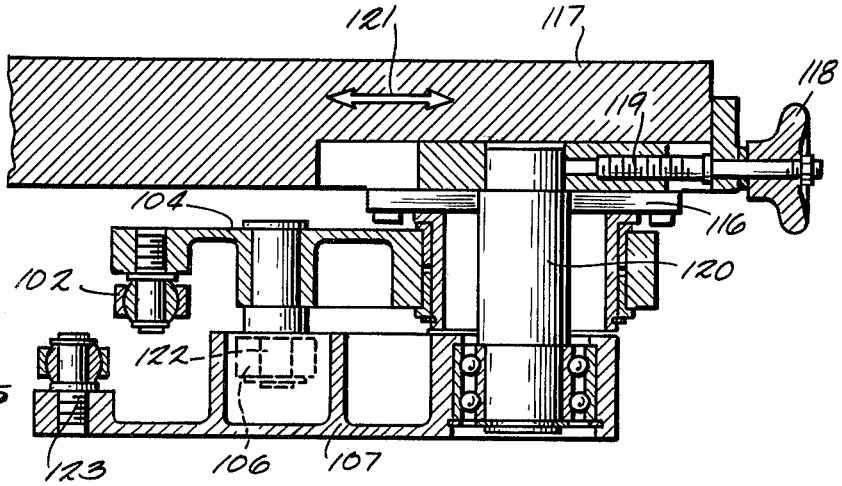
FIG. 15 is a cross-sectional view taken generally along line 15—15 of FIG. 14.

Referring once again to FIG. 14, it can be seen that the arm 107 is pivotedly mounted on the axle 120 in a carrier 116 which is slideably mounted in the frame 117, as shown in FIG. 15.

The hand wheel 118 connected to the screw-threaded shaft 119 causes the axle 120 to move right and left as shown by the arrow 121. This movement causes the arm 107 to pass above the ball-bearing roller 106 and thus change the distance between the center of the axle 120 and the axis 122 of the ball-bearing 106. This also changes the distance between the axis 122 of the ball-bearing 106 and the axis 123 of the pivot which is the lower end of the shaft 108.

Although I have provided a series of connecting points 124, 125 and 126 in the arm 110, (which positions 124, 125 and 126 can be used to make gross changes in the position and location of the diameter control roll 95), I have also provided the hand wheel 118 to make very fine, small adjustments in the location of the roll 95 by rotating the hand wheel 118.

The relocation of the upper end of the shaft 108 in any of the holes 124, 125 and 126 can only be accomplished while the machine is not operating, but the position of the arm 107 above the ball-bearing roller 106 can be adjusted by the hand wheel 118 while the machine is operating.

Figure 13:
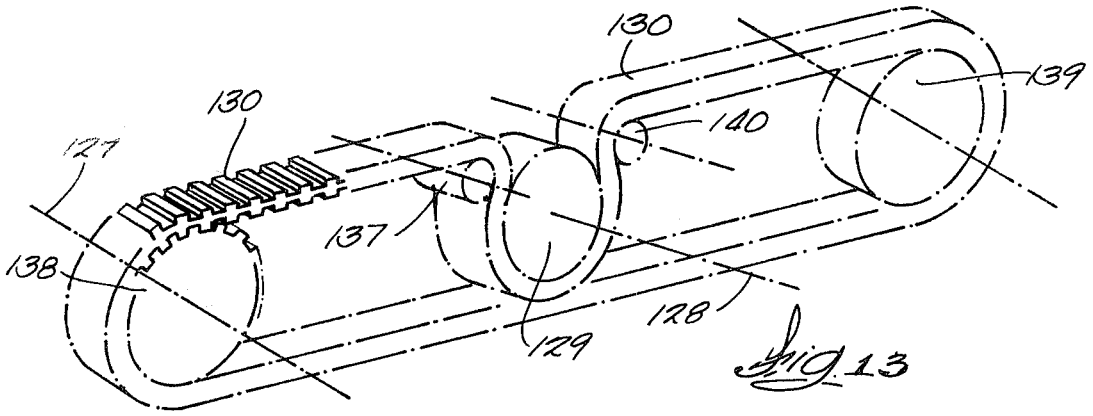
FIG. 13 is a schematic, perpective view of the means for driving a perforating roll at an angle to the power shaft.

In FIG. 13 I have shown a device for driving the knife blade roll 37 whose axis 127 is disposed at an angle to the axis 128 of the power drive roll 129. This device includes a double face timing belt 130 which travels around the drive roll 129, guide roll 137, knife blade roll gear 138, guide roll 139 and guide roll 140. The axes of rolls 137 and 140 are parallel to axis 128, while the axis of roll 139 is parallel to axis 127. The angle between axis 127 and axis 129 is approximately 1°–2°.

It will be apparent from all of the foregoing that an important aspect of this invention is the provision of means for accurate severance of a rapidly moving wide web of paper. This permits the positioning of a line of perforations above the channel 46 so that the separation always takes place at the end of a specific sheet, thus affording precise sheet-count in the finished log or roll of paper on the core.

Although the apparatus has been described for applying the glue to the core, it is to be understood that the glue may be applied to the web (as by a spray or other means) on the drum 41, immediately after the channel 46, thus eliminating the glue application rolls 86 and 87 and glue applicator station 88.

It is to be understood that the present invention may be embodied in other specific forms without departing from the spirit or special attributes hereof, and it is therefore desired that the present embodiments be considered in all respects as illustrative, and therefore not restrictive, reference being made to the appended Claims rather than to the foregoing description to indicate the scope of the invention.

What is claimed as new and desired to be protected by Letters Patent are the following:

1. In a rewinder constructed and arranged to receive a web of sheet material, a first winder roll having a channel in the surface thereof, a web separator roll having web separator means said first winder roll and said web separator roll being operatively interconnected by means which cause them to rotate in synchronism, the channel in said first winder roll and the means in said web separator roll constructed and arranged so that at selected moments during rotation of said rolls the said means and the said channel are in operative juxtaposition to each other to move said web into said channel a distance in excess of the stretch and tensile characteristics of said web so as to tear said web in said channel, said web seprator means being a rigid member which forces the web into the channel, including vacuum means on each side of the channel to hold the web against the first winder roll, the vacuum means being a plurality of ports disposed closely adjacent and on one side of said channel in said first winder roll so as to hold the tail of said web adjacent the channel after the web separation takes place, wherein a second set of ports is disposed in the surface of the first winder roll, on the other side of the channel, so as to hold the leading edge of said web adjacent said channel after web separation takes place but spaced sufficiently from the channel to permit a portion of said leading edge to double back upon itself between the said channel and the second set of ports 2. The rewinder of claim 1 wherein said second set of ports is disposed closely adjacent the said channel so as to hold the leading edge of said web against said first winder roll closely adjacent said channel and to prevent it from doubling back upon itself.

3. The rewinder of claim 1 wherein the first winder roll and the web separator roll are operatively interconnected by drive means so as to rotate in synchronism, with control means to keep said rolls spaced apart while a length of said web passes therebetween but to bring said rolls together at a selected moment with said channel and said separation means in alignment.

4. The rewinder of claim 3 wherein one of said lines of perforation overlies said channel when the rolls come together.

5. The rewinder of claim 1 including means for perforating said web along a line transverse to the line of movement of the web.

6. The rewinder of claim 5 including a double-faced timing belt and at least one inclined guide-roll for said belt, said belt passing round a gear-portion of the rotating roll in said perforation means whereby to enable said rotating roll of said perforation means to be disposed at an angle other than 90° to the line of travel of the said web through said perforation means.

7. The rewinder of claim 1 including a vacuum separator disposed within said first winder roll to prevent the vacuum from operating at said ports after said ports have passed said separator whereby to release said web from the surface of said first winding roll, and including an air-jet in the non-vacuum area of said first winder roll disposed so as to force air through said ports and assist in detaching the tail of the web from the surface of the first winder roll.

8. In a rewinder constructed and arranged to receive a web of sheet material, a first winder roll having a channel in the surface thereof, a web separator roll having web separator means, said first winder roll and said web separator roll being operatively interconnected by means which cause them to rotate in synchronism, the channel in said first winder roll and the means in said web separator roll constructed and arranged so that at selected moments during rotation of said rolls the said means and the said channel are in operative juxtaposition to each other to move said web into said channel a distance in excess of the stretch and tensile characteristics of said web so as to tear said web in said channel, a second winder roll disposed near said first winder roll so as to define a throat between the first and second winder rolls, means for delivering a core at said throat core-advancing means constructed and arranged to feed the core from the core delivery means into contact with the first and second winder rolls at said throat, the width of said thoat being slightly less than the diameter of said core, diameter control means including a diameter control roll disposed adjacent said second winder roll and constructed and arranged to overlie said core after it has passed through said throat, speed-control means for said first winder roll, said second winder roll and said diameter control roll, operatively interconnected and arranged so that the first winder roll, the second winder roll and the diameter control roll may, if desired, rotate at the same peripheral speeds and also be operatively interconnected so that the relative speeds of the first winder roll and the second winder roll may be varied so as to force a core disposed in said throat to pass between the said first winder roll and the said second winder roll to a position between the second winder roll and the diameter control roll, the first winder roll, the second winder roll and the diameter control roll being constructed and arranged so as to rotate at the same peripheral speeds, if desired, whereby to rotate the core and a web of paper thereon between them and thus to wind a web of paper upon said core, said diameter control roll supported by means arranged to move said diameter control roll away from the second winder roll whereby to constrain the web of paper and core between the diameter control roll and the second winder roll and thus to control the diameter of said core and web as it is wound into a log, the speeds of the second winder roll and the diameter control roll being variable with respect to each other so as to move the log from between the said two rolls at the precise instant when the web portion severed by the web separating means appears at the throat, and thus to discharge the log from between the second winder roll and the diameter control roll, said core advancing means arranged to move a second core into the throat at the moment of discharge of the log so that the second core can pick up the leading edge of the separated web and wrap it around itself as it is advanced through said throat.

9. The rewinder of claim 8 including glue application means for said core which consists of a pair of rolls, one roll rotating in a glue bath and having a plurality of raised portions to pick up said glue, the other of said rolls being a back-up roll, the space between the raised portions of said glue applicator roll and said back-up roll surface being slightly less than the diameter of a core, said rolls rotating at differential speeds so as to spin and transfer said core as it passes between said rolls and thus apply strips of glue around the entire cicumference of said core.

10. The rewinder of claim 8 including a core-receiving hopper disposed to hold a core beneath said throat until the separated portion of the web appears at the throat, core advancing means to bring said core from said hopper into said throat in alignment with the leading edge of the separated web as said first winding roll brings said leading edge into said throat whereupon the glue on said core picks up the leading edge of said web as core passes through the throat, causing the web to wind up on said core.

11. The rewinder of claim 10 including speed control mechanism to slow down the rotation of the second winder roll with respect to the rotation of the first winder roll at the moment when a core is advanced into the throat by the core advancing means whereby said first winder roll causes said core to pick up the leading edge of the sheet, rotate through said throat and wind the web upon the core; and thereafter the speed of rotation of the second winder roll is increased so as to be the same as the peripheral speed of the first winder roll causing the core to continue rotation at web speed and to wind a web thereupon into a log of paper.

12. The winder of claim 8 including speed control mechanism for said diameter control roll and said second winder roll which causes the said rolls to rotate at the same peripheral speed and to wind a log of paper therebetween, and also including speed control means to decelerate the said second winder roll with respect to the speed of said diameter control roll thereupon to cause said log to be discharged from between said two rolls after the tail of the separated web has moved through said throat.

13. The winder of claim 12 including drive means for said diameter control roll which precisely locates the diameter control roll with respect to the second winder roll whereby to control the diameter of the log of paper being wound therebetween, said diameter control roll moving away from said second winder roll as the diameter of the log a paper therebetween increases, the rotary speed of the diameter control roll and the second winder roll being the same until the completed log of paper is wound therebetween, whereupon the second winder roll is decelerated relative to the rotation of the diameter control roll whereby to cause the log of paper to be discharged from between said rolls.

14. The rewinder of claim 8 wherein the diameter control roll position control mechanism includes variable adjustment to regulate the distance between the second winder roll and the diameter control roll while a log is being wound.

15. The rewinder of claim 8 wherein vacuum ports and vacuum means are included in the second winder roll to assist in transferring the leading edge of the web to the core when the core is in the throat.

* * * * *